US005850960A

United States Patent [19]

Cadwell

[11] Patent Number: 5,850,960

[45] Date of Patent: Dec. 22, 1998

[54] WRAPPING PAPER HOUSING AND CUTTING APPARATUS

[76] Inventor: Charles E. Cadwell, 159 Paramount Dr., Wood Dale, Ill. 60191

[21] Appl. No.: 876,689

[22] Filed: Jun. 17, 1997

Related U.S. Application Data

[63] Continuation of Ser. No. 599,681, Feb. 12, 1996, abandoned.

[51] Int. Cl.[6] ..... B26F 3/02

[52] U.S. Cl. ..... 225/58; 225/77; 225/91

[58] Field of Search ..... 225/6, 7, 33, 39, 225/46, 48, 49, 52, 56, 79, 87, 88, 91, 66, 77, 58

[56] References Cited

U.S. PATENT DOCUMENTS

| | | | |
|---|---|---|---|
| 325,992 | 9/1885 | Thain | 225/6 X |
| 482,039 | 9/1892 | Granger | 225/33 X |
| 697,773 | 4/1902 | Altermatt et al. | 225/66 |
| 1,116,834 | 11/1914 | Nelson | 225/91 X |
| 1,524,463 | 1/1925 | Webb | 225/88 X |
| 1,718,143 | 6/1929 | Hancock | 225/56 X |
| 1,821,947 | 9/1931 | Ross | 225/56 |
| 1,842,288 | 1/1932 | Rietmann | 225/33 X |
| 1,865,399 | 6/1932 | McClintock | 225/33 X |
| 1,909,527 | 5/1933 | Fischer | 225/58 |
| 1,915,736 | 6/1933 | Hurlbut | 225/56 X |
| 1,952,431 | 3/1934 | Gluck et al. | 225/91 X |
| 2,151,064 | 3/1939 | Alexander | 225/33 |
| 2,229,961 | 1/1941 | Deane | 225/91 X |
| 2,250,236 | 7/1941 | Russell | 225/7 |
| 2,334,997 | 11/1943 | Doll | 225/49 |
| 2,409,217 | 10/1946 | Lessin | 225/33 X |
| 2,462,776 | 2/1949 | Price | 225/33 |
| 2,472,712 | 6/1949 | Lifschitz | 225/46 X |
| 2,588,729 | 3/1952 | Jardine | 225/58 |
| 2,878,980 | 3/1959 | Waltz | 225/39 |
| 3,005,580 | 10/1961 | Malia | 225/39 |
| 3,070,273 | 12/1962 | Warp | 225/58 |
| 3,159,323 | 12/1964 | Hawk | 225/49 X |
| 3,197,102 | 7/1965 | Bates et al. | 225/58 |
| 3,262,620 | 7/1966 | Burt et al. | 225/46 X |
| 3,738,552 | 6/1973 | Roeder . | |
| 4,130,229 | 12/1978 | Pagnini | 225/33 X |
| 4,796,792 | 1/1989 | Nelson et al. . | |
| 4,858,807 | 8/1989 | Cvek | 225/91 X |
| 5,445,703 | 8/1995 | Steeves et al. | 225/33 X |
| 5,480,080 | 1/1996 | Ferguson | 225/91 X |

FOREIGN PATENT DOCUMENTS

| | | | |
|---|---|---|---|
| 581550 | 9/1958 | Italy | 225/58 |
| 21553 | 11/1893 | United Kingdom | 225/58 |

*Primary Examiner*—Rinaldi I. Rada
*Assistant Examiner*—Boyer Ashley
*Attorney, Agent, or Firm*—McDonnell Boehnen Hulbert & Berghoff

[57] ABSTRACT

A paper cutting apparatus comprising a housing partially enclosing a roll of paper and a cutting member disclosed along an opening of the housing. A leading edge of a roll of paper is unrolled through the opening of the housing and is linearly severed along the cutting member.

19 Claims, 2 Drawing Sheets

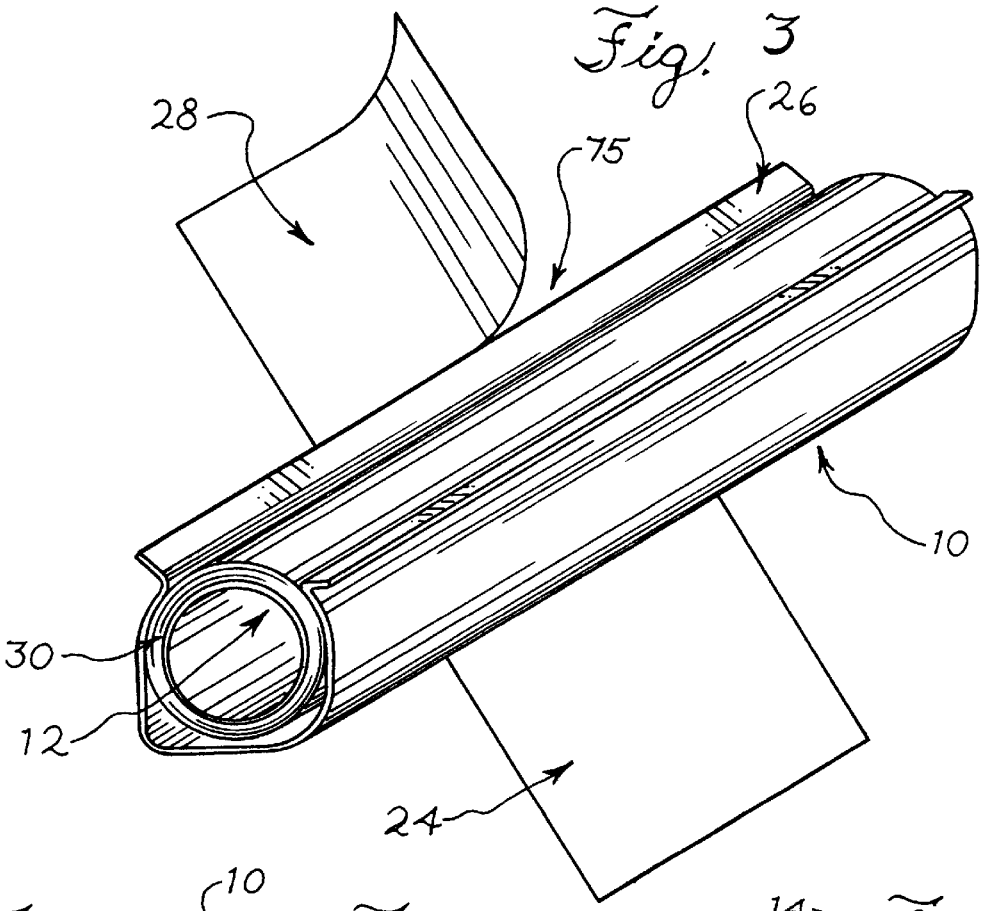
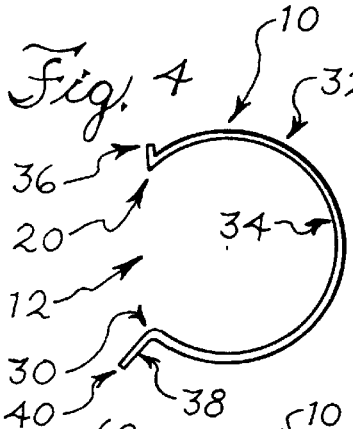
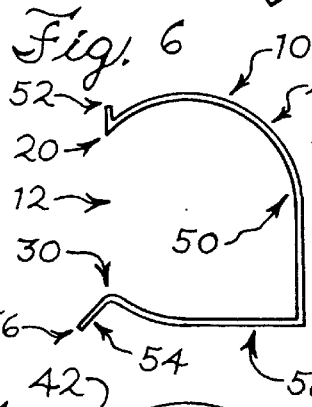
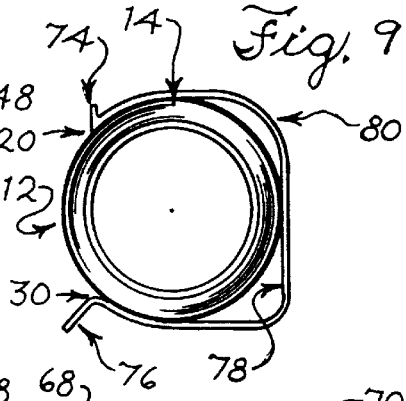
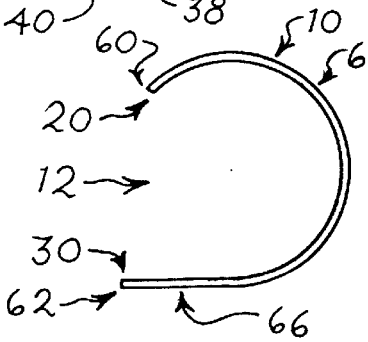
Fig. 7
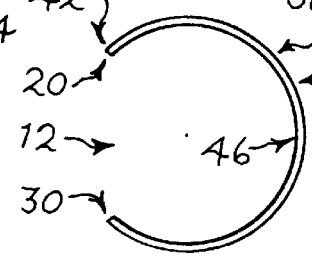
Fig. 5
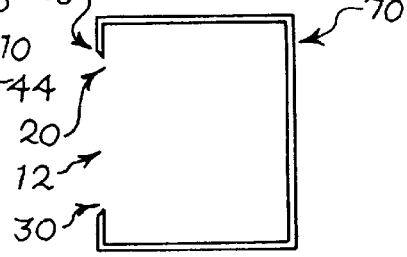
Fig. 8

WRAPPING PAPER HOUSING AND CUTTING APPARATUS

This is a continuation of a prior application, Serial No. 08/599,681, filed Feb. 12, 1996, and now abandoned.

FIELD OF THE INVENTION

The present invention relates generally to an apparatus for use with a roll of wrapping paper and, more particularly, to a housing that partially encloses a roll of wrapping paper. The housing comprises a cutting edge extending from an opening in said housing to allow a section of wrapping paper to be unrolled and linearly severed from the roll.

BACKGROUND OF THE INVENTION

Traditionally, gifts and present are exchanged at holidays such as Christmas, Valentine's day, and birthdays. It is common practice to wrap the gifts and presents with wrapping paper before presenting them to the intended recipient. Wrapping paper is typically available and packaged in rolls. The wrapping paper is usually tightly wound around cardboard tubing. The length of the tubing often varies, but generally comes in lengths of between 2 and 4 feet.

When wrapping a present, a desired length section of wrapping paper is unwound and cut from the roll. Typically, the cutting action of a pair of hand scissors is used to linearly sever the desired length section of wrapping paper from the roll. However, it is often difficult to cut the paper in a straight line, and often an uneven or even ripped edge of wrapping paper results. In addition, during the wrapping process, the scissors are often misplaced, creating frustration for the wrapper. Moreover, the use of scissors can be dangerous. Furthermore, the wrapping paper may unwind from its initial tightly wound state to a loosely wound state. In its loosely wound state, the wrapping paper remaining on the roll may become crinkled and bent, thus creating an undesirable result. To prevent the wrapping paper from becoming loosely wound, a small piece of tape may be placed on the leading edge of the wrapping paper to maintain the roll in a tightly wound state. When removing the tape, the leading edge may be torn or the tape may remove a portion of the wrapping paper.

SUMMARY OF THE INVENTION

In view of the above, the present invention relates to a device that fits over the wrapping paper roll. The device comprises a housing that partially encloses the outer surface of roll of wrapping paper. The housing may maintain the wrapping paper in its tightly wound state. In this fashion the need to use tape to keep the wrapping paper tightly wound when not in use is eliminated. In addition, the roll of wrapping paper may be maintained in a tightly wound state during use.

The device may further include a cutting edge along the length of the housing that allows a section of the wrapping paper to be removed from the roll with a clean and even linear cut. Accordingly, the need to use scissors to remove a section of wrapping paper from the roll is eliminated. The device is preferably portable, safe, lightweight, inexpensive, of a one-piece construction, and principally designed for home use.

The device may be equipped with a second cutting edge that allows the removed section of wrapping paper to be cut down to a smaller size to accommodate the size of the particular object to be wrapped. The device may also be designed to allow the device to set on flat surface, such as a tabletop or counter, in a stable fashion.

These and other features and advantages of the invention will become apparent upon a review of the following detailed description of the presently preferred embodiments of the invention, taken in conjunction with the appended drawings.

BRIEF DESCRIPTION OF THE DRAWINGS

FIG. 3 is a perspective view of a wrapping paper housing wherein a removed section of wrapping paper is linearly severed along a second cutting member.

FIGS. 4–8 are cross-sectional views of various embodiments of the wrapping paper housing.

FIG. 9 is a cross-sectional view of the wrapping paper housing shown in FIG. 1.

DETAILED DESCRIPTION OF THE PRESENTLY PREFERRED EMBODIMENTS

Figure 1:
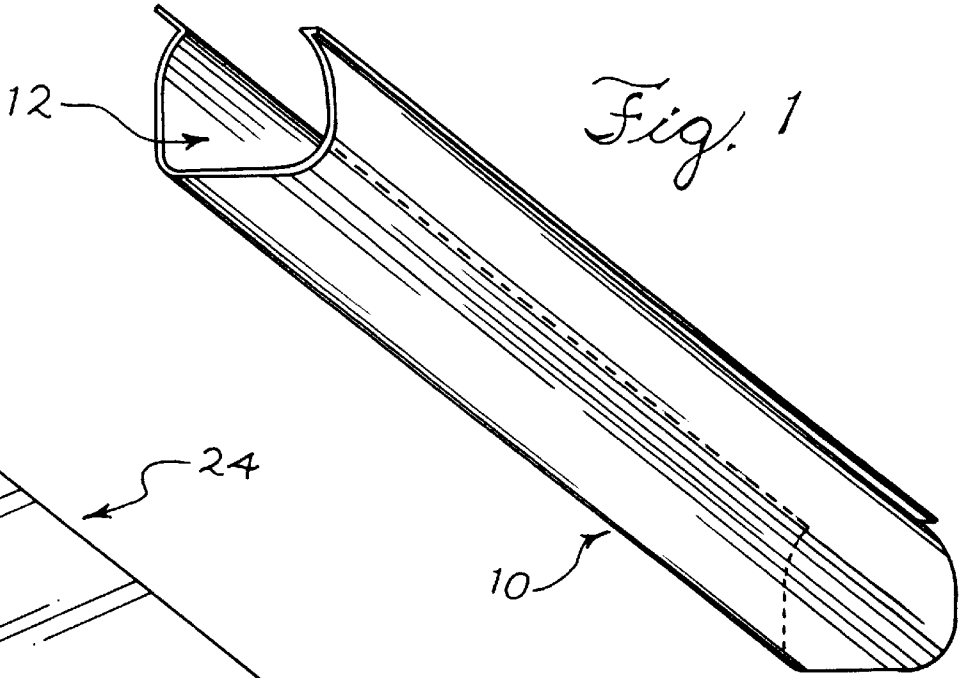
FIG. 1 is a perspective view of one preferred embodiment of a wrapping paper housing with a cutting edge.

Referring now to the detailed drawings, and more particularly to FIG. 1, a presently preferred embodiment of the invention is illustrated. A housing 10 is shown with an opening 12 extending longitudinally the length of said housing 10. The housing 10 fits over and partially encloses a roll of wrapping paper. The opening 12 allows a leading edge of the roll of wrapping paper to be unrolled through said opening. The housing 10 is preferably manufactured from a plastic material through conventional plastic extrusion techniques. In one preferred embodiment, the housing 10 is a thin-walled housing constructed from extruded high impact styrene such as FINA 825 polystyrene manufactured by Dow. As those skilled in the art recognize, the housing 10 may also be made from a variety of materials, including other plastics, as well as aluminum, fiberglass, or the like without departing from the spirit and scope of the invention.

Figure 2:
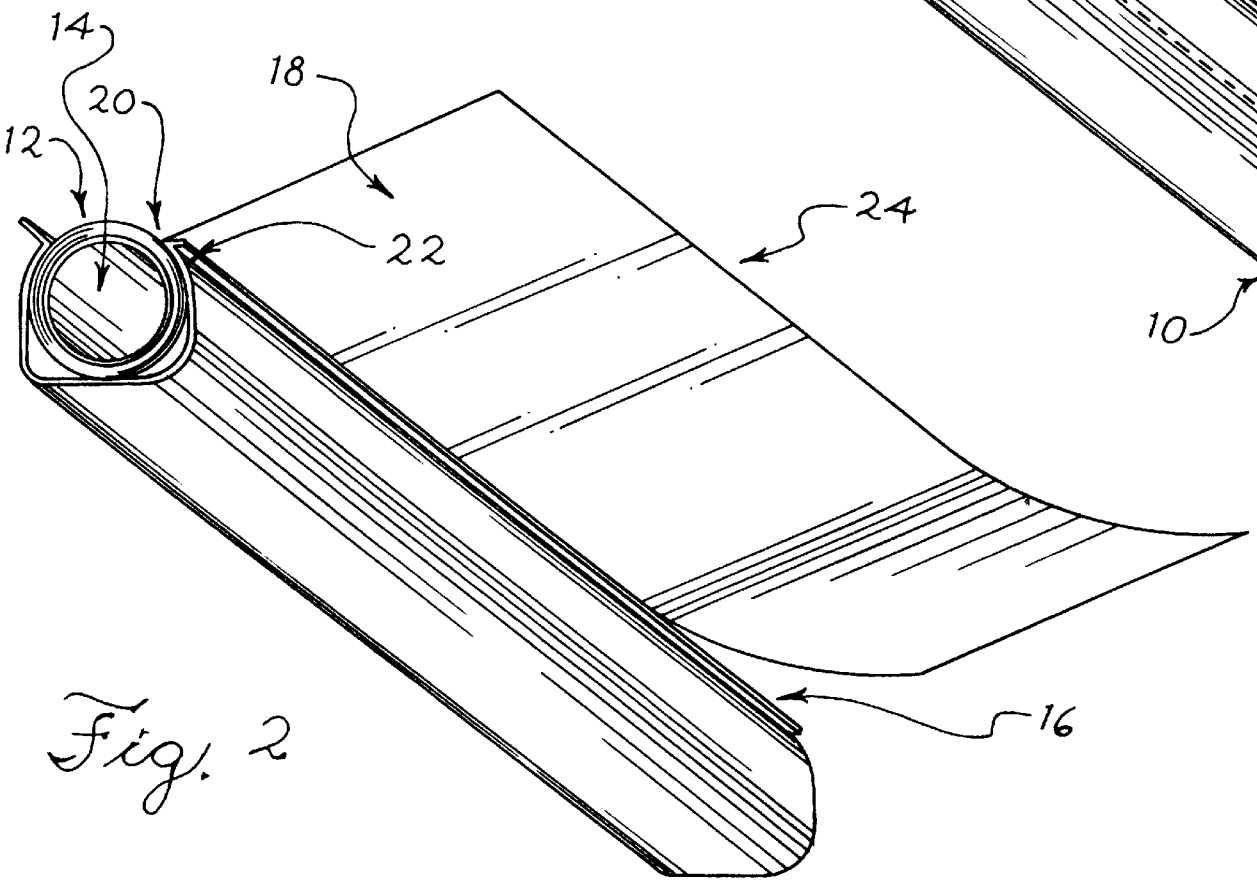
FIG. 2 is a perspective view of a wrapping paper housing wherein a section of wrapping paper is linearly severed from the roll along a cutting member.

FIG. 2 illustrates a thin-walled housing 10 partially enclosing a roll of wrapping paper 14. A cutting member 16 is shown linearly severing a section of wrapping paper 18. To linearly sever the section of wrapping paper 18, a leading edge 24 of the roll of wrapping paper 14 is pulled through the opening 12 until a desired length of wrapping paper has been unrolled from the roll. The section of wrapping paper 18 to be removed is pulled upwards from the housing 10 and is linearly severed along cutting member 16. In this manner, the wrapping paper section 18 is removed from the roll of wrapping paper 14 with a clean and even cut. The cutting member 16 extends from a first side 20 of said opening of the housing 10 for substantially the length of the housing. The cutting member 16 may be in contact with the outer surface 22 of the roll of wrapping paper 14 or extend away from the roll of wrapping paper 14 as shown in FIG. 2.

FIG. 3 illustrates housing 10 with a second cutting member 26 outwardly extending from a second side 30 of the opening 12 along the length of housing 10. The second cutting member 26 may be used to further sever a section of wrapping paper 24 along the outermost edge 75 of cutting member 26. As shown in FIG. 3, the cutting member 26 is a thin-walled member outwardly-extending from a second side 30 of the opening 12 along the length of housing 10. The section of wrapping paper 28 to be further severed is pulled upwards from the cutting member 26 and is linearly severed along cutting edge 75. In this manner, the wrapping paper section 28 may be removed from the section of wrapping paper 24 with a clean and even cut.

In FIG. 4 a thin-walled wrapping paper housing 10 is shown with an external shape 32 that is substantially circular and an internal shape 34 that is also substantially circular. A first cutting member 36 is shown extending outwardly from a first side 20 of opening 12. A leading edge from a roll of wrapping paper may be unrolled through opening 12 and linearly severed along cutting member 36. A second cutting member 38 is shown extending outwardly from a second side 30 of opening 12. Cutting edge 40 of second cutting member 38 is also shown.

In FIG. 5 another embodiment of a thin-walled wrapping paper housing 10 is shown with an external shape 44 that is substantially circular and an internal shape 46 that is also substantially circular. A first cutting member 42 is shown disposed along a first side 20 of opening 12. A leading edge from a roll of wrapping paper may be unrolled through opening 12 and linearly severed along cutting member 42.

In FIG. 6 another embodiment of a thin-walled wrapping paper housing 10 is shown with an external shape 48 that is partially flat along a side 58 to allow the housing to set on a flat surface in a stable fashion. Internal shape 50 is at least partially circular. A first cutting member 52 is shown extending outwardly from a first side 20 of opening 12. A second cutting member 54 with cutting edge 56 is shown extending outwardly from a second side 30 of opening 12.

In FIG. 7 another embodiment of a thin-walled wrapping paper housing 10 is shown with an external shape 64 that is partially flat along a side 66 to allow the housing to set on a flat surface in a stable fashion. A first cutting member 60 is shown disposed along a first side 20 of opening 12. A second cutting member 62 is shown outwardly extending from a second side 30 of opening 12.

In FIG. 8 a further embodiment of a thin-walled wrapping paper housing 10 is shown with an external shape 70 that is substantially square. A first cutting member 68 is shown disposed along a first side 20 of opening 12.

In FIG. 9 a preferred embodiment of a thin-walled wrapping paper housing is shown with an external shape 80 that is partially square and an internal shape 78 that is at least partially circular and also partially square. The wrapping paper housing is shown partially enclosing a roll of wrapping paper 14 and the internal shape 78 is shown in frictional engagement with the outer surface of the roll of wrapping paper 14. A first cutting member 74 is shown disposed along a first side 20 of opening 12. A second cutting member 76 is shown outwardly extending from a second side 30 of opening 12.

It will be appreciated by those skilled in the art that the cutting members may be disposed along the side of the opening 12 and in contact with the outer surface of a roll of wrapping paper as shown by cutting members 42 in FIG. 5 and 60 in FIG. 7. In addition, the cutting members may be extend outwardly from a side of opening 12 as shown for example by cutting members 36 and 38 in FIG. 4. The outwardly extending cutting members may extend at any angle from the housing. For example in FIG. 4 cutting member 38 extends at a right angle from the housing 10 and cutting member 36 extends at an angle of less than 90 degrees from the housing. An outwardly extending cutting member could be placed at any angle, that is greater than, less than, or equal to 90 degrees. In addition the cutting member could simply extend away from the housing as shown by cutting member 62 in FIG. 7.

To facilitate linearly severing a section of wrapping paper with a clean and even cut, the cutting member may have a cutting edge that is angled or serrated. FIGS. 1–3 depict a housing that partially encloses a roll of wrapping paper for the length of the housing. However, a housing could be provided wherein only portions of the housing enclose the roll of wrapping paper, and are connected by a cutting member extending substantially the length of the roll of wrapping paper.

Although the present invention has been described by way of illustration and example, various changes and modifications may be made without departing in any way from the spirit of the invention and the scope of the appended claims.

I claim:

1. An apparatus for use with a roll of paper, said apparatus comprising:

a housing having a cross-section including an internal shape and an external shape, said internal shape adapted to partially enclose an outer surface of said roll, said length of said housing having a length that is about equal to the length of the roll and said housing is substantially longer than a diameter of said roll, said housing having an opening extending longitudinally for the length of said housing to allow a leading edge of said paper to be unrolled through said opening; and said internal shape of said housing terminating in a first cutting member disposed along a first side of the opening of said housing to linearly sever a section of paper from said roll in a first cutting operation, wherein a first end of said first cutting member is in direct contact with the outer surface of said roll before, during, and after said first cutting operation, and wherein a second end of said first cutting member extends outwardly from said opening of said housing;

and wherein said housing and said first cutting member are integrally formed with no relative movement between said housing and said first cutting member at any time, including before, during, or after said first cutting operation;

and wherein the internal shape of said housing has a diameter substantially equal to the diameter of said roll to maintain said roll in its initial tightly wound state.

2. The apparatus of claim 1 wherein the internal shape of said housing is at least partially circular.

3. The apparatus of claim 1 wherein the cross-section of said housing comprises a uniform thin wall.

4. The apparatus of claim 3 wherein said housing comprises extruded plastic material having a uniform cross-section.

5. The apparatus of claim 1 wherein said first cutting member outwardly extends from said first side of said opening of said housing.

6. The apparatus of claim 5 wherein said first cutting member comprises a straight thin-walled member.

7. The apparatus of claim 1 further including a cutting means outwardly extending from said housing for at least a portion of the length of said housing for further linearly severing said section of wrapping paper along an outermost edge of said cutting means in a second cutting operation.

8. The apparatus of claim 7 wherein said cutting means is generally disposed on a second side of said opening.

9. The apparatus of claim 7 wherein said cutting means outwardly extends from a second side of said opening of said housing for performing said second cutting operation when said section of wrapping paper is placed between a flat surface and said cutting means by linearly severing said section at a point at which said cutting means contacts said flat surface.

10. The apparatus of claim 1 wherein the external shape of said housing is at least partially flat to allow said housing to rest on a flat surface in a stable fashion.

11. The apparatus of claim 10 wherein said first cutting member outwardly extends from said housing for substantially the length of said housing, said first cutting member disposed generally opposite from the partially flat side of said external shape.

12. The apparatus of claim 11 wherein said extends from said first side of said opening of said housing, said first side of said opening generally disposed opposite from said partially flat side of said external shape.

13. An apparatus for use with a roll of paper, said apparatus comprising:

a housing made of extruded plastic material and having a uniform cross-section including an internal shape and an external shape, said internal shape adapted to partially enclose an outer surface of said roll of paper for substantially the length of said roll, said housing having a length that is about equal to the length of the roll and said length of said housing is substantially longer than a diameter of said roll, said housing having an opening extending longitudinally for the length of said housing to allow a leading edge of said paper to be unrolled through said opening, said internal shape of said housing terminating in a first cutting member disposed along a first side of the opening of said housing to linearly sever a section of paper from said roll in a first cutting operation, wherein a first end of said first cutting member is in direct contact with the outer surface of said roll before, during, and after said first cutting operation, and wherein a second end of said first cutting member extends outwardly from said opening of said housing;

and wherein said housing and said first cutting member are integrally formed as a one-piece plastic extrusion with no relative movement between said housing and said first cutting member at any time including, before, during or after said first cutting operation;

and wherein the internal shape of said housing has a diameter substantially equal to the diameter of said roll to maintain said roll in its initial tightly wound state.

14. The apparatus of claim 13 wherein said first cutting member comprises a thin-walled member.

15. The apparatus of claim 13 further including cutting means outwardly extending from said housing for at least a portion of the length of said housing for further linearly severing said section of wrapping paper along an outermost edge of said cutting means in a second cutting operation.

16. The apparatus of claim 15 wherein said cutting means is generally disposed on a second side of said opening.

17. The apparatus of claim 16 wherein said cutting means outwardly extends from said second side of said opening of said housing.

18. The apparatus of claim 16 wherein the external shape of said housing is at least partially flat to allow said housing to rest on a flat surface in a stable fashion.

19. The apparatus of claim 18 wherein said cutting means outwardly extends from said second side of said opening, and wherein an outermost edge of said cutting means terminates at a point about in contact with said flat surface when said housing is resting on said partially flat external shape of said housing, for performing said second cutting operation when said section of wrapping paper is placed between the flat surface and said cutting means by linearly severing said section at a point at which said cutting means contacts said flat surface.

* * * * *